US011499353B1

(12) United States Patent
Manswell

(10) Patent No.: US 11,499,353 B1
(45) Date of Patent: Nov. 15, 2022

(54) REMOVABLE DOOR LOCK

(71) Applicant: Kurtis Manswell, Fairburn, GA (US)

(72) Inventor: Kurtis Manswell, Fairburn, GA (US)

( * ) Notice: Subject to any disclaimer, the term of this patent is extended or adjusted under 35 U.S.C. 154(b) by 388 days.

(21) Appl. No.: 16/752,896

(22) Filed: Jan. 27, 2020

(51) Int. Cl.
*E05C 19/00* (2006.01)
*G07C 9/00* (2020.01)

(52) U.S. Cl.
CPC ..... *E05C 19/003* (2013.01); *G07C 9/00309* (2013.01); *E05Y 2900/132* (2013.01); *G07C 2009/00325* (2013.01)

(58) Field of Classification Search
None
See application file for complete search history.

(56) References Cited

U.S. PATENT DOCUMENTS 4,079,972 A 3/1978 Hagopian
4,762,350 A * 8/1988 Hurtado ..... E05C 19/003 292/259 R
5,165,741 A 11/1992 Everett
5,429,399 A * 7/1995 Geringer ..... E05B 45/06 292/DIG. 65
5,641,187 A * 6/1997 Frolov ..... E05C 19/166 292/251.5
6,609,738 B1 * 8/2003 Roth ..... E05B 65/108 292/144
7,661,733 B1 * 2/2010 Angel ..... E05C 19/003 292/259 R
8,022,573 B2 * 9/2011 Powers ..... E05B 39/005 307/64
10,047,551 B2 * 8/2018 Eickhoff ..... E05F 15/40

* cited by examiner

*Primary Examiner* — K. Wong
(74) *Attorney, Agent, or Firm* — Sanchelima & Associates, P.A.; Christian Sanchelima; Jesus Sanchelima

(57) ABSTRACT

A removeable door lock device for temporary installation to a door for additional security is disclosed herein. The removeable door lock device includes shock pads, two sets of metal rods, and a metal base. A first of the shock pads is placed on a back side of a door for leverage and support and a second of the shock pad is configured on the opposite wall for leverage and support. The door lock device is easily mounted on to an existing door without having to alter the existing door. Additionally, the door lock may be configured to be locked and unlocked through the mobile device of a user.

11 Claims, 5 Drawing Sheets

REMOVABLE DOOR LOCK

BACKGROUND OF THE INVENTION

1. Field of the Invention

The present invention relates to removable door lock and, more particularly, to a door lock for temporary installation that attaches to the top of a door and door frame to effectively lock the door in a closed position.

2. Description of the Related Art

Several designs for a door lock have been designed in the past. None of them, however, include a removeable door lock device for temporary installation to a door for additional security. The removeable door lock device includes shock pads, two sets of metal rods, and a metal base. A first of the shock pads is placed on a back side of a door for leverage and support and a second of the shock pad is configured on the opposite wall for leverage and support. It is known that an individual may often have the need for additional security for their home and apartment. A space of living within an apartment or house may come with a door having only one basic lock. Additionally, the property owner of the home or apartment may not allow any alterations to be made to the door. As a result, individuals that desire additional security within these living spaces lack the additional security to make them feel safe. Therefore, there is a need for a removable door lock device that does not include the need of altering an existing door or changing the lock of the door. The removable door is easily mounted onto an existing door and provides additional security to a user.

Applicant believes that a related reference corresponds to U.S. Pat. No. 5,165,741 issued for a security door bar. The cited disclosure includes a security door bar the is adapted to prevent the opening of a door by intruders. The door bar includes a resilient metal bar which carries a polygon shaped block through which pressure is applied to the door. Applicant believes another related reference corresponds to U.S. Pat. No. 4,079,972 issued for a portable door bar. The cited disclosure includes a portable door bar that includes a telescopic rod having a loop at one end for insertion around a doorknob and a spacer at the other end for contacting a wall adjacent to a closed door. However, the cited references differ from the present invention because they collectively fail to address the structural benefit of the present invention. The present invention includes a door lock device having shock pads, two sets of three shock pad metal rods, and a metal base. The structure of the present invention allows a user to easily mount and lock the door lock onto an existing door without altering the structure of the existing door.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a removable door lock that attaches to an existing door without altering the structure of the existing door. The door lock easily attaches to the top of end of the door and further attaches to the door frame.

It is another object of this invention to provide a removable door lock that provides increased home safety to a user.

Additionally, the door lock provides safety in locations where a user may be renting out a space during a vacation.

It is still another object of the present invention to provide a removable door lock that includes a communication module that allows a user to unlock and lock the device using their mobile device.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
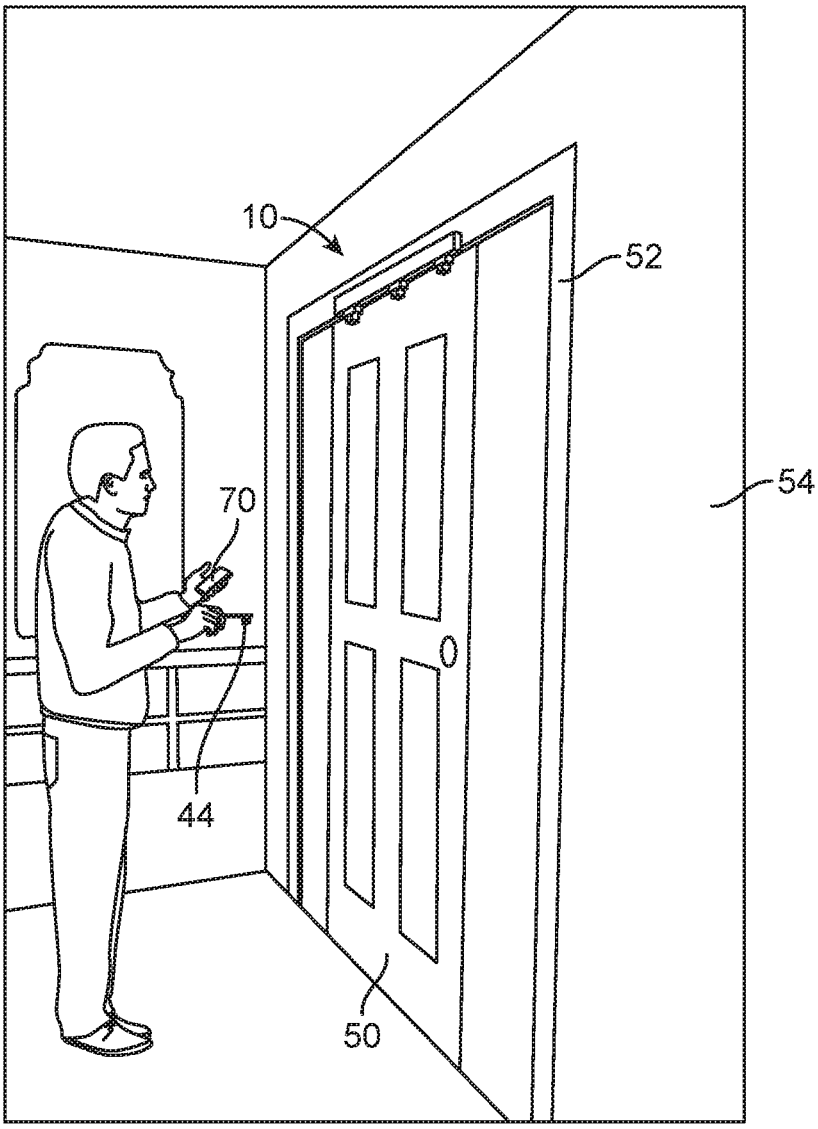
FIG. 1 represents an isometric view of door lock 10 in its operating environment attached to a door 50 in accordance to an embodiment of the present invention.

Referring now to the drawings, where the present invention is generally referred to with numeral 10, it can be observed a door lock 10 including a mounting assembly 20 and a lock assembly 40.

Figure 2:
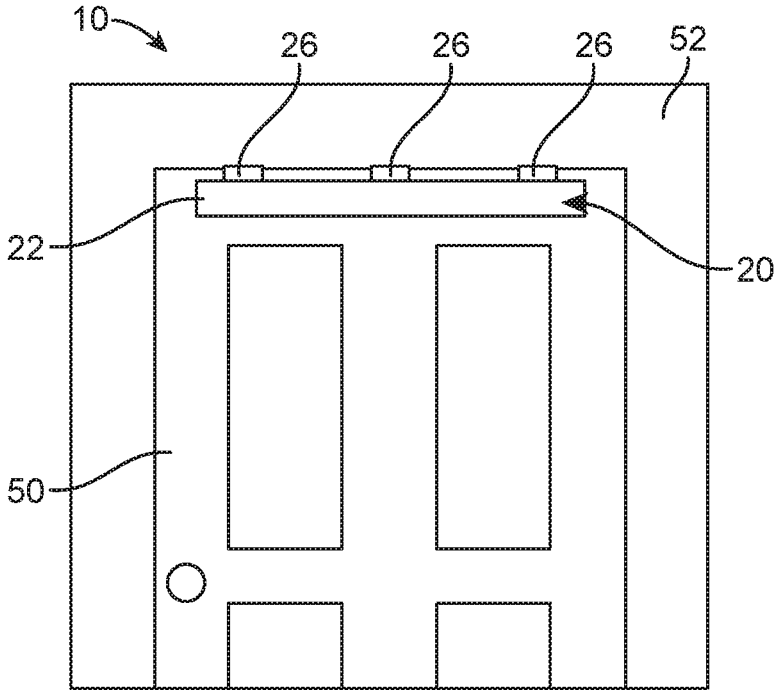
FIG. 2 shows a rear view of door 50 having door lock 10 mounted to a top end in accordance to an embodiment of the present invention.
Figure 3:
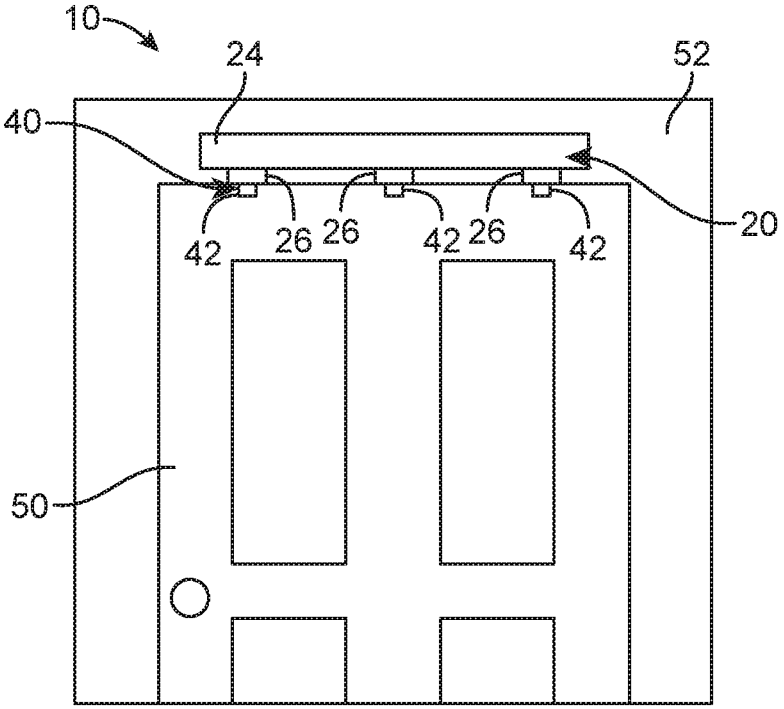
FIG. 3 illustrates a front view of door 50 having door lock 10 mounted to a door frame 52 in accordance to an embodiment of the present invention.
Figure 4:
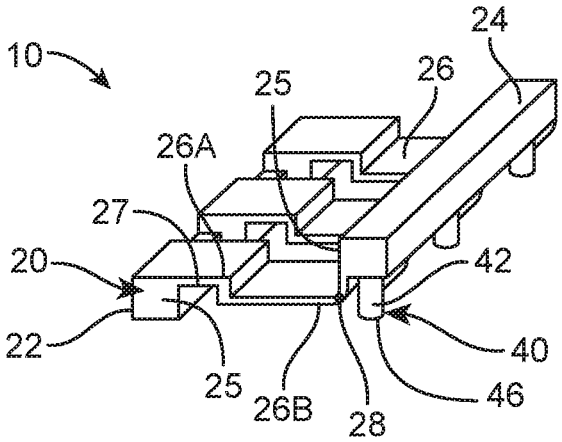
FIG. 4 is a representation of an isometric view of door lock 10 having mounting assembly 20 and lock assembly 40 in accordance to an embodiment of the present invention.
Figure 5:
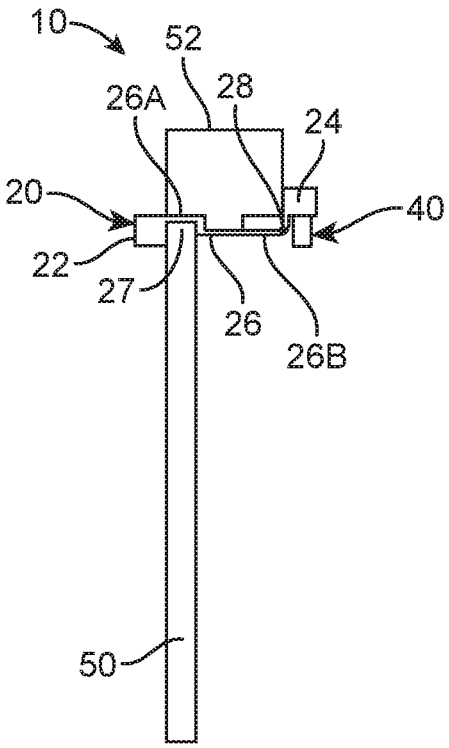
FIG. 5 shows a side view of door lock 10 mounted onto door 50 in a locked position in accordance to an embodiment of the present invention.
Figure 6:
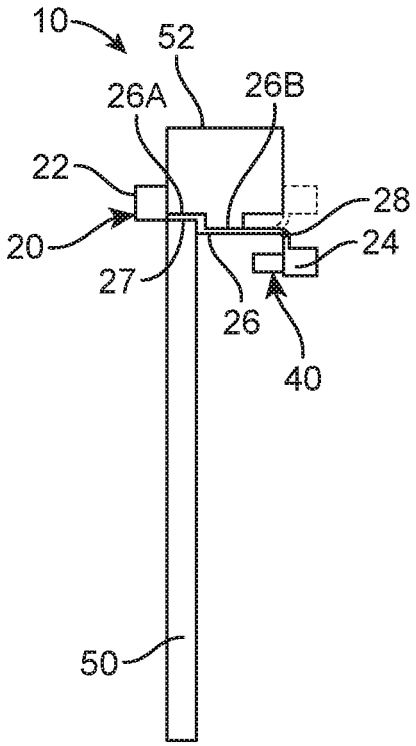
FIG. 6 shows a side view of door lock 10 mounted onto door 50 in an un-locked position in accordance to an embodiment of the present invention.
Figure 7:
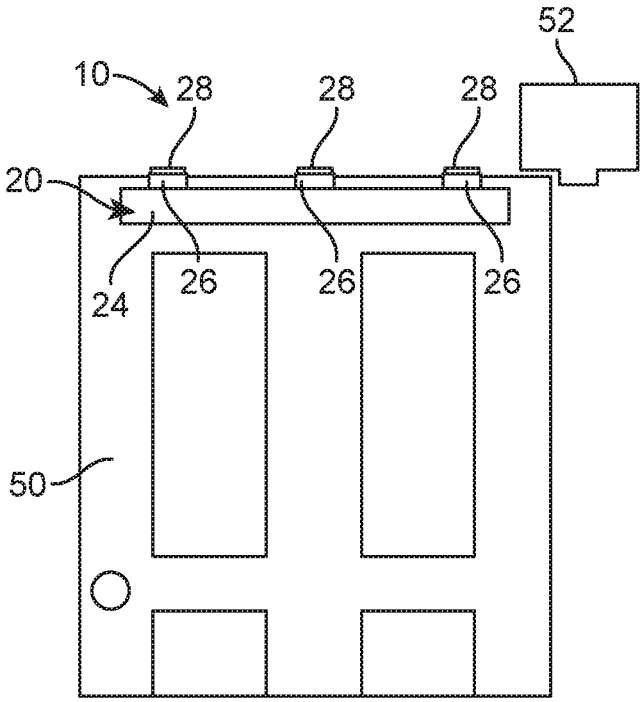
FIG. 7 illustrates a side view of door lock 10 mounted onto door 50 with door 50 in an open position and door lock 10 in an un-locked position in accordance to an embodiment of the present invention.

Mounting assembly 20 includes a first metal bar 22 mounted onto a door 50 and a second metal bar 24 mounted onto a door frame 52. In one embodiment, first metal bar 22 and second metal bar 24 are made of a strong metal material such as iron, carbon fiber, and the like. Additionally, first metal bar 22 and second metal bar 24 may feature an elongated cubic rectangular shape. It should be understood that other embodiments of door lock 10 may feature a first metal bar 22 and second metal bar 24 made of varying materials and shapes. Door 50 may represent the entrance to a user's home in includes door frame 52 surrounding door 50. Additionally, door 50 and door frame 52 may be located on a wall 54 representing the division between and inside and outside environment. In one embodiment, first metal bar 22 is mounted near a top portion of a front end of door 50. Additionally, first metal bar 22 is located within an outside environment of wall 70. First metal bar may be mounted flush with a top edge of the front end of door 50. As seen in FIG. 2, first metal bar 22 may only partially extend across the width of door 50. Other embodiments may feature metal bar 22 extending across the entire width of door 50. Second metal bar 24 may be mounted within the inside environment of wall 54 on door frame 52. In one embodiment, second metal bar 24 is mounted near a bottom edge of the top of door frame 52. Second metal bar 24 may also be mounted in such a configuration that it is flush with the top edge of door frame 52. Similarly, with first metal bar 22, second metal bar 24 may extend the entire width of door frame 52 or may only partially extend across the width of door frame 52. As depicted in FIG. 3, second metal bar 24 extends partially across the width of door frame 52. In one embodiment, first metal bar 22 and second metal bar 24 may be of identical shape and size. In another embodiment, first metal bar 22 and second metal bar 24 may each have varying dimensions.

Mounting assembly 20 further includes shock pad material 25 located on each of first metal bar 22 and second metal bar 24. Shock pad material 25 may be a rectangular piece of pad material that features the same shape and size as first metal bar 22 and second metal bar 24. In one embodiment, shock pad material 25 is placed between the point of contact of first metal bar 22 and door 50. Additionally, shock pad material 25 may be placed between the point of contact of second metal bar 24 and door frame 52. Shock pad material 25 may extend across the entire back end of first metal bar 22 and second metal bar 24. In another embodiment, shock pad material 25 extends partially across the back end of first metal bar and second metal bar 24. In yet another embodiment, shock pad material 25 is mounted onto first metal bar 22 and second metal bar 24 is mounted thereon through means of threaded fasteners as known in the art of shock pads. Shock pad material 25 provides the necessary protection needed to door 50 and door frame 52 when a force is applied to door lock 10.

Mounting assembly 20 further includes metal plates 26 each having a first end 26A and a second end 26B. In one embodiment door lock 10 includes at least two metal plates 26. As observed in the drawings, three metal plates may be used with door lock 10. In one embodiment, metal plates 26 may be rectangular flat metal pieces made of a sturdy metal such as iron, carbon fiber, and the like. Metal plates 26 are used to connect first metal bar 22 and second metal bar 24. In one embodiment, metal plates 26 is integrally attached to first metal bar 22. In another embodiment, metal plates 26 are removably attached to first metal bar 22. Furthermore, metal plates 26 includes a slot 27 located at first end 26A. Slot 27 may be in the form of a rectangular opening the receives the upper edge of door 50. It should be understood that the shape of slot 27 may conform to the shape of the top edge of door 50. Furthermore, slot 27 provides an effective way to mount door lock 10 onto door 50. Metal plates 26 may be mounted onto second metal bar 24 through hinges 28 located at a second end 26B. Hinges 28 allow second metal bar 24 to be engaged in a locked state or a release state. In the locked state, door lock 10 prevents a user from opening door 50. In a released state, door 50 may be freely opened and closed while still having door lock 10 mounted thereon.

Lock assembly 40 includes a locking member 42 located on second metal bar 24. Locking member 42 may be of a Yale lock, sash lock, dead lock, or any lock type. In one embodiment, locking member 42 is located on a bottom end of second metal bar 24. Additionally, locking member 42 allows a user to lock door lock 10 in a locked state. In the locked state, second metal bar 24 remains in a vertical position against door frame 52 and prevents a user from the outside environment from entering the inside environment. In one embodiment, at least one locking member 42 may be located on second metal bar 24. As depicted in the drawings, three locking members 42 may be provided to correspond with each of metal plates 26. A key 44 may be provided to a user to engage locking member 42. Key 44 as known in the art of locking mechanisms, may be any separate member that can be used to engage and disengage locking member 42. Furthermore, lock assembly 40 may include a wireless communication module 46 located within locking member 42. Wireless communication module 46 is hardware within locking member 42 that allows a user to connect to locking member 42 using a mobile device 70. Additionally, the user may utilize their mobile device to engage door lock 10 in a locked state or released state using their mobile device.

Door lock 10 provides additional security to a home and is easily mounted on an existing door. Furthermore, door lock 10 proves useful for a user living in a home that does not permit alterations to the existing door provided. The user may simply mount door lock 10 on the top edge of their door and then engage the door lock 10 in a locked position using a key or their mobile device. The door lock 10 may further prove useful when traveling abroad and staying in unfamiliar places. Once the door lock 10 is not needed, the user can simply remove it without alternating or damaging the existing door. Door lock 10 provides a much-needed solution to users in need of additional security to their homes.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a removable door lock, comprising:

a. a mounting assembly including a first metal bar mounted to a front end of a door, a second metal bar mounted to a door frame located on a back end of said door, said first and second metal bar including a shock pad material on a back end, said mounting assembly further including at least two metal plates connecting said first and second metal bars, said at least two metal plates each including a slot at a first end, wherein said slot receives an upper edge of said door, said at least two metal plates are hingedly attached to said second metal bar at a second end, said system for a removable door lock prevents of altering or damaging said door frame or said door structure; and b. a lock assembly including at least one locking member located on said second metal bar, said at least one locking member receives a key to engage said second metal bar in a locked position or a release position.

2. The system for a removable door lock of claim 1 wherein said first and second metal bars are each rectangular in shape and of the same dimensions which conforms with said door wherein said first metal bar is mounted to a top portion of a door while said second metal bar remains from an exterior top surface of said door frame.

3. The system for a removable door lock of claim 1 wherein said shock pad material is placed between a point of contact of said first metal bar and said door frame while another of said sock pad materials is placed between a point of contact of said second metal bar and door frame.

4. The system for a removable door lock of claim 1 wherein said slot passes through along said first metal bar defining a rectangular hollow portion.

5. The system for a removable door lock of claim 1 wherein said first metal bar is integrally attached to said at least two metal plates by an edge thereof defining a 90 angle.

6. The system for a removable door lock of claim 1 wherein said first metal bar is removably attached to said at least two metal plates with said first metal bar being on a top surface of said door and said at least two metal plates remaining on a top side portion of said door.

7. The system for a removable door lock of claim 1 wherein said at least one locking member has a cylindrical body and extends outwardly from a bottom end of said second metal bar being aligned with at least one of said metal plates.

8. The system for a removable door lock of claim 1 wherein said locking member includes a wireless communication module that connects with a mobile device to engage and disengage said locking member.

9. The system for a removable door lock claim 8 wherein a user may engage said second metal bar in said locked position or said release position by sliding at least one of said locking through said first and second metal bar by said mobile device.

10. A system for a removable door lock, comprising:

a. a wall dividing an inside and outside environment;

b. a door having a front end and a back end located on said wall, said door further including a door frame;

c. a mounting assembly including a first metal bar mounted to a top portion of said front end of said door, said mounting assembly further including a second metal bar mounted to a bottom portion of said door frame in said inside environment, wherein said first metal bar and said second metal bar are rectangular in shape which conforms with said door wherein said first metal bar is mounted to a top portion of a door while said second metal bar remains from an exterior top surface of said door frame, said first metal bar having a first shock pad placed between a point of contact between said door and said first metal bar, said second metal bar having a second shock pad placed between a point of contact between said door frame and said second metal bar, said mounting assembly further including three elongated metal plates connecting said first metal bar and said second metal bar, said three elongated metal plates being equally spaced apart, said three elongated metal plates being integrally connected to said first metal bar, a rectangular slot formed at a first end of said three elongated metal plates to receive a top edge of said door, said three elongated metal plates hingedly attached to said second metal bar at a second end, said slot passes through along said first metal bar defining a rectangular hollow portion; and d. a lock assembly including a three locking members located on a bottom end of said second metal bar, wherein said three locking members each receive a key to lock said second metal bar in a locked position, wherein said three locking members further include a wireless communication module therein to engage and disengage said locking member, wherein a user may lock and release said second metal bar through a mobile device to slide at least one of said locking through said first and second metal bar.

11. A system for a removable door lock, consisting of:

a. a wall dividing an inside and outside environment;

b. a door having a front end and a back end located on said wall, said door further including a door frame;

c. a mounting assembly including a first metal bar mounted to a top portion of said front end of said door, said mounting assembly further including a second metal bar mounted to a bottom portion of said door frame in said inside environment, wherein said first metal bar and said second metal bar are rectangular in shape which conforms with said door wherein said first metal bar is mounted to a top portion of a door while said second metal bar remains from an exterior top surface of said door frame, said first metal bar having a first shock pad placed between a point of contact between said door and said first metal bar, said second metal bar having a second shock pad placed between a point of contact between said door frame and said second metal bar, said mounting assembly further including three elongated metal plates connecting said first metal bar and said second metal bar, said three elongated metal plates being equally spaced apart, said three elongated metal plates being integrally connected to said first metal bar, a rectangular slot formed at a first end of said three elongated metal plates to receive a top edge of said door, said three elongated metal plates hingedly attached to said second metal bar at a second end, said slot pass through along said first metal bar defining a rectangular hollow portion; and d. a lock assembly including a three locking members located on a bottom end of said second metal bar, wherein said three locking members each receive a key to lock said second metal bar in a locked position, wherein said three locking members further include a wireless communication module therein to engage and disengage said locking member, wherein a user may lock and release said second metal bar through a mobile device to slide at least one of said locking through said first and second metal bar.

* * * * *